US007395011B2

(12) United States Patent
Tanaka

(10) Patent No.: US 7,395,011 B2
(45) Date of Patent: Jul. 1, 2008

(54) IMAGE FORMING APPARATUS WITH CLEANING DEVICE FOR REMOVING REMAINING TONER FROM OUTER SURFACE OF PHOTOSENSITIVE MEMBER

(75) Inventor: Nariaki Tanaka, Osaka (JP)

(73) Assignee: Kyocera Mita Corporation (JP)

( * ) Notice: Subject to any disclaimer, the term of this patent is extended or adjusted under 35 U.S.C. 154(b) by 87 days.

(21) Appl. No.: 11/443,337

(22) Filed: May 30, 2006

(65) Prior Publication Data

US 2006/0269322 A1 Nov. 30, 2006

(30) Foreign Application Priority Data

May 27, 2005 (JP) ..... 2005-155423

(51) Int. Cl.
*G03G 15/02* (2006.01)
*G03G 21/00* (2006.01)

(52) U.S. Cl. ..... 399/128; 361/221; 399/175

(58) Field of Classification Search ..... 399/128, 399/129, 174, 175, 176; 361/221
See application file for complete search history.

(56) References Cited

U.S. PATENT DOCUMENTS 4,757,345 A * 7/1988 Ohashi et al. ..... 399/128
5,630,199 A * 5/1997 To ..... 399/175
5,751,405 A * 5/1998 Aita et al. ..... 399/175 X
5,852,758 A * 12/1998 Wibbels ..... 399/176
6,332,064 B1 * 12/2001 Sato et al. ..... 399/128 X
6,415,122 B1 * 7/2002 Hara et al. ..... 399/128
6,954,600 B2 * 10/2005 Fujita et al. ..... 399/129 X
6,975,823 B2 * 12/2005 Onishi et al. ..... 399/128
2001/0016127 A1 * 8/2001 Watanabe et al. ..... 399/174 X
2003/0049049 A1 * 3/2003 Hoshi et al. ..... 399/129
2004/0086298 A1 * 5/2004 Ojima et al. ..... 399/129

FOREIGN PATENT DOCUMENTS

JP 4-60660 2/1992
JP 6-83249 3/1994

* cited by examiner

*Primary Examiner*—Sophia S Chen
(74) *Attorney, Agent, or Firm*—Gerald E. Hespos; Anthony J. Casella

(57) ABSTRACT

An image forming apparatus has a charge roller, a charge erasing device and a preliminary voltage-applying member disposed around a rotationally movable photosensitive member. The charge roller subjects a surface of the photosensitive member to a charge process while contacting the surface of the photosensitive member. The charge erasing device is on an upstream side of the photosensitive member relative to the charge roller and erases the charged area in the photosensitive member. The preliminary voltage-applying member is on an upstream side of photosensitive member relative to the charge erasing device and applies to the surface of the photosensitive member a voltage of the same polarity as the voltage applied from the charge roller to the surface, while contacting the surface. The preliminary voltage-applying member is reciprocated along the surface of the photosensitive member and in a direction orthogonal to the movement direction of the surface.

9 Claims, 6 Drawing Sheets

IMAGE FORMING APPARATUS WITH CLEANING DEVICE FOR REMOVING REMAINING TONER FROM OUTER SURFACE OF PHOTOSENSITIVE MEMBER

BACKGROUND OF THE INVENTION

1. Field of the Invention

The present invention relates to an image forming apparatus suitable as a copying machine, a facsimile machine or a printer.

2. Description of the Related Art

Heretofore, there has been known an image forming apparatus as disclosed in Japanese Patent Laid-Open Publication No. 04-60660 (hereinafter referred to as "document D1"). This image forming apparatus is designed to apply a bias voltage through a charge roller to an outer peripheral surface of a photosensitive drum which is being rotated about a given drum shaft so as to electrostatically charge the outer peripheral surface uniformly. Then, a laser beam generated based on image information is emitted onto the uniformly-charged outer peripheral surface of the photosensitive drum to eliminate a part of the uniformly charged area so as to form an electrostatic latent image. Toner particles are then supplied to the electrostatic latent image to form a toner image. This toner image on the outer peripheral surface of the photosensitive drum is electrostatically attracted toward a sheet having charges of opposite polarity formed using a transfer roller, and transferred onto the sheet. After the transfer process, residual toner particles on the outer peripheral surface is removed by a given cleaning device. Then, for the next image forming job, the outer peripheral surface is subjected to a charge process based on the charge roller.

In the above type of image forming apparatus, the document D1 discloses a brush roller provided as a means to clean an outer peripheral surface of the charge roller. The brush roller is designed to be rotated in such a manner that the outer peripheral surface of the charge roller is slidingly rubbed with and cleaned by bristles on an outer peripheral surface of the brush roller. According to this technique, even if residual toner particles and fine additive particles which have not been able to be removed from the outer peripheral surface of the photosensitive drum by the cleaning device are attached on the outer peripheral surface of the charge roller, these undesirable substances will be removed by the brush roller. This makes it possible to prevent the outer peripheral surface of the photosensitive drum from being nonuniformly charged so as to avoid deterioration in image quality due to charge nonuniformity.

In the process of transferring a toner image on the photosensitive drum to a sheet, electric charges having opposite polarity to that of electric charges of the toner image are imparted to the sheet, and the toner image formed on the outer peripheral surface of the photosensitive drum is electrostatically taken away by the opposite-polarity charges, and transferred to the sheet. Consequently, the opposite-polarity charges are applied to the outer peripheral surface of the photosensitive drum to form a so-called "transfer memory".

Even using the technique disclosed in the document D1, the charge roller cannot remove such a transfer memory, and a problem about charge nonuniformity occurring in the outer peripheral surface of the photosensitive drum still remains.

An image forming apparatus disclosed in Japanese Patent Laid-Open Publication No. 06-83249 (hereinafter referred to as "document D2") can be taken as one example of measures for solving the above problem. The image forming apparatus disclosed in the document D2 comprises an exposure lamp provided as a charge erasing device and disposed on an upstream side of a charge roller (primary charge roller) designed to be applied with a DC voltage or a superimposed voltage of DC and AC voltages, and an additional charge roller (preliminary charge roller) disposed on an upstream side of the exposure lamp. The document D2 discloses a technique of applying a DC voltage, or a superimposed voltage, having the same polarity and value as those of the voltage in the primary charge roller, to an outer peripheral surface of a photosensitive drum by the preliminary charge roller, erasing electric charges by the exposure lamp, and then imparting electric charges to the outer peripheral surface of the photosensitive drum by the primary charge roller.

According to the technique disclosed in the document D2, the preliminary charge roller is operable to counteract opposite-polarity charges on the photosensitive drum, and the charge erasing device is operable to erase the charges. Then, the primary charge roller is operable to impart given electric charges to the outer peripheral surface of the photosensitive drum. This makes it possible to effectively prevent charge nonuniformity in the outer peripheral surface of the photosensitive drum.

In the image forming apparatus disclosed in the document D2, if toner particles and/or an extraneous substance (magnetic fine particles as an additive to be attached onto surfaces of toner particles, etc.) attached on the outer peripheral surface of the photosensitive drum are not fully removed therefrom even though the opposite-polarity charges on the outer peripheral surface of the photosensitive drum are erased by the preliminary charge roller, these undesirable substances will be attached onto the primary charge roller. Consequently, electrical characteristics of an outer peripheral surface of the primary charge roller become uneven to cause difficulty in uniformly charging the outer peripheral surface of the photosensitive drum. Thus, a problem about inability to reliably eliminate charge nonuniformity in the outer peripheral surface of the photosensitive drum still remains.

SUMMARY OF THE INVENTION

It is an object of the present invention to provide an image forming apparatus capable of suppressing the occurrence of charge nonuniformity in an outer peripheral surface of a photosensitive member even if an extraneous substance is attached onto an outer peripheral surface of a charge roller.

Through various researches on the cause of charge nonuniformity occurring in a surface of a photosensitive member, the present invention has been accomplished based on clarification of a mechanism of occurrence thereof. Heretofore, it has been considered that charge nonuniformity is caused by submicron-order additive particles, specifically an extraneous substance mixed in toner particles, such as silica and titanium, which has slipped through a clearance between a blade of a cleaning device and the surface of the photosensitive member and remained thereon without being removed, and then attached onto the surface of the charge roller. As the result of various experimental tests, the inventor found that, even if an extraneous substance is attached onto the outer peripheral surface of the charge roller, as long as the extraneous substance is uniformly attached thereonto, discharge stability in the charge roller can be maintained without occurrence of charge nonuniformity in the outer peripheral surface of the photosensitive member.

According to one aspect of the present invention accomplished based on the above knowledge, there is provided an image forming apparatus which comprises: a photosensitive member adapted to be rotationally or circulatingly moved; a charge roller adapted to subject a surface of the photosensitive member to a charge process while being in contact with the surface of the photosensitive member; a charge erasing device disposed around the photosensitive member and on an upstream side relative to the charge roller in a direction of the rotational or circulating movement of the photosensitive member, and adapted to erase the charged area in the photosensitive member; a preliminary voltage-applying member disposed around the photosensitive member and on an upstream side relative to the charge erasing device in the direction of the rotational or circulating movement of the photosensitive member, and adapted to apply to the surface of the photosensitive member a voltage of the same polarity as that of a voltage to be applied from the charge roller to the surface, while being in contact with the surface; and a reciprocating mechanism for reciprocating the preliminary voltage-applying member along the surface of the photosensitive member and in a direction orthogonal to the movement direction of the surface.

In the above image forming apparatus, the surface of the photosensitive member being rotationally or circulatingly moved is applied with a voltage from the charge roller in contact therewith, and then subjected to an exposure process, so that an electrostatic latent image is formed on the surface of the photosensitive member in sequence. Then, toner particles are supplied to the electrostatic latent image to form a toner image, and this toner image is transferred to a given sheet.

After the transfer process, the surface of the photosensitive member is subjected to a cleaning process based on a given cleaning device. Then, the cleaned surface of the photosensitive member is applied with the voltage of the same polarity as that of the voltage in the charge roller, from the preliminary voltage-applying member which is being reciprocated in two directions which are orthogonal to the movement direction of the surface of the photosensitive member, and parallel to the surface of the photosensitive member, by the reciprocating mechanism. In this way, before a voltage is re-applied by the charge roller, the cleaned surface of the photosensitive member is subjected to the preliminary charge process. Thus, even if a transfer memory of opposite-polarity charges is formed and left on the cleaned surface of the photosensitive member, the preliminary voltage-applying member can counteract the transfer memory. Subsequently, the surface of the photosensitive member is subject to a charge erasing process based on the charge erasing device, and then uniformly re-charged by the charge roller to perform the next image forming job.

As above, the preliminary voltage-applying member is reciprocated along the surface of the photosensitive member and in a direction orthogonal to the movement direction of the surface of the photosensitive member, by the reciprocating mechanism. Thus, even if the surface of the photosensitive member has an extraneous substance attached thereon, the extraneous substance is uniformly spread over the surface of the photosensitive member according to the reciprocating movements. That is, even if the uniformly-spread extraneous substance on the surface of the photosensitive member reaching an outer peripheral surface of the charge roller is attached onto the outer peripheral surface of the charge roller, the attached extraneous substance will be uniformly distributed over the outer peripheral surface of the charge roller. Therefore, the surface of the photosensitive member subjected to the charge process through contact with the charge roller can be uniformly charged. This makes it possible to effectively prevent the occurrence of charge nonuniformity in the surface of the photosensitive member so as to reliably avoid image nonuniformity due to the charge nonuniformity.

BRIEF DESCRIPTION OF THE DRAWINGS

FIGS. 5A to 5C are explanatory diagrams of an operation of the reciprocating mechanism, wherein FIGS. 5A to 5C show the reciprocating mechanism, respectively, in a state when the conductive brush is located at an intermediate position, in a state when the conductive brush is located at a leftward position, and in a state when the conductive brush is located at a rightward position.

DETAILED DESCRIPTION OF THE PREFERRED EMBODIMENTS

Figure 1:
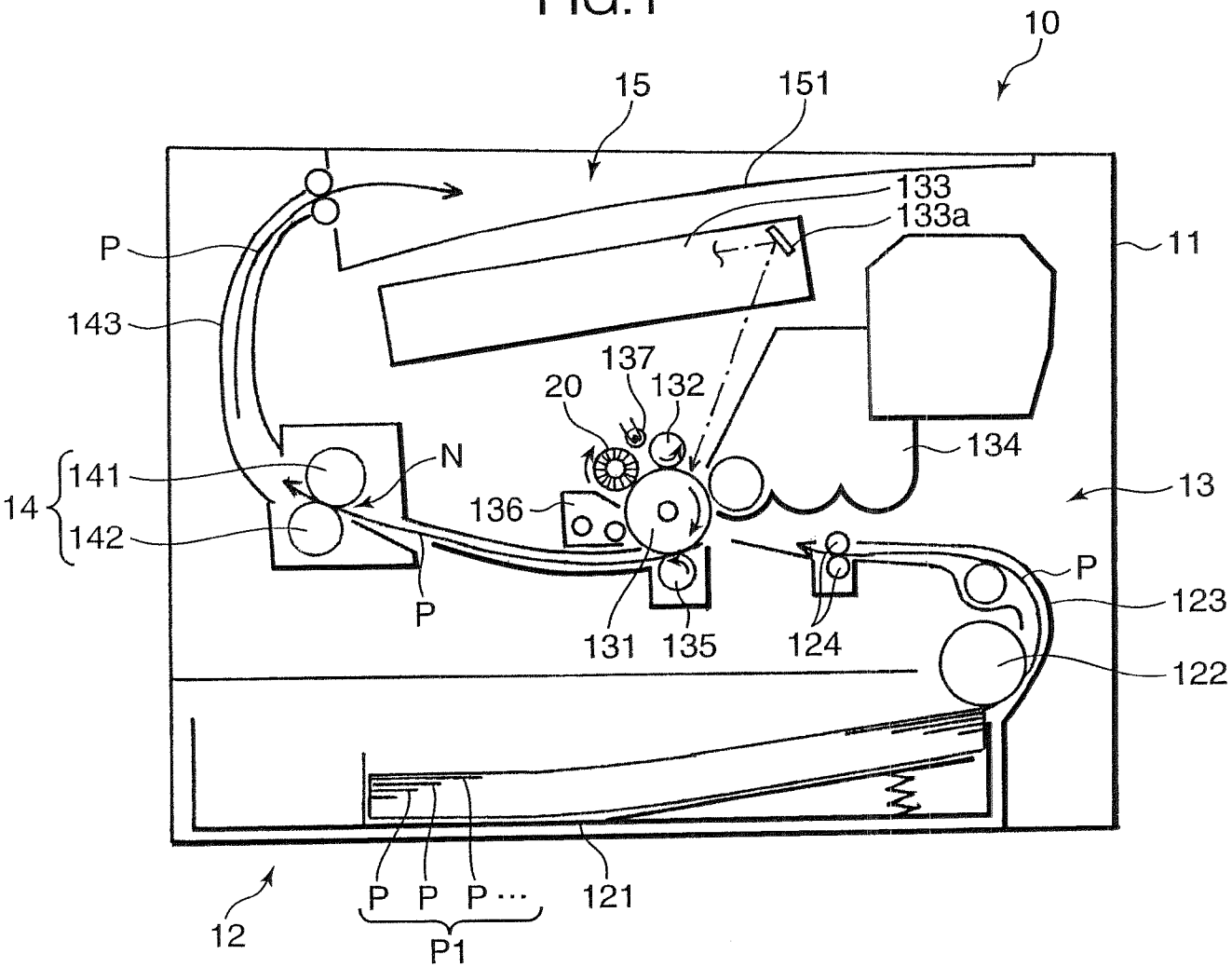
FIG. 1 is an explanatory sectional front view showing an internal structure of a printer as an image forming apparatus according to one embodiment of the present invention.

FIG. 1 is an explanatory sectional front view showing an internal structure of a printer as an image forming apparatus according to one embodiment of the present invention. As shown in FIG. 1, the printer (image forming apparatus) 10 comprises: an apparatus body 11 which is internally provided with a sheet storage section 12 for storing a stack of sheets (transfer targets) P as an object of a printing job, a transfer section 13 for subjecting each of the sheets P fed from the sheet stuck P1 stored in the sheet storage section 12, to an image transfer process, and a fixing section 14 for subjecting the sheet P after being subjected to the transfer process based on the transfer section 13, to a fixing process; and a sheet receiving section 15 formed at a top portion of the apparatus body 11 to receive the sheet P after being subjected to the fixing process based on the fixing section 14.

The sheet storage section 12 includes a given number (one in this embodiment) of sheet cassettes 121 detachably inserted into the apparatus body 11. A pickup roller 122 is disposed at an upstream end (right end in FIG. 1) of the sheet cassette 121 to pick up the sheets P from the sheet stack P1 on a one-by-one basis. The sheet P picked up from the sheet cassette 121 by driving of the pickup roller 122 is fed to the transfer section 13 through a sheet feeding passage 123 and a registration roller pair 124 disposed at a downstream end of the sheet feeding passage 123.

The transfer section 13 is provided as a means to subject the sheet P to the transfer process based on image information transmitted, for example, from a computer. The transfer section 13 includes a photosensitive drum 131 designed to be rotatable about a drum axis extending in a longitudinal direction (in a direction orthogonal to the drawing sheet of FIG. 1). The transfer section 13 also includes a charge roller 132, a light exposure device 133, an image development device 134, a transfer roller 135, a cleaning device 136, an electrically conductive brush (preliminary voltage-applying member) 20 and a charge erasing lamp (charge erasing device) 137, which are disposed along an outer peripheral surface of the photosensitive drums 131.

In this embodiment, the charge roller 132 is disposed at a position immediately above the photosensitive drum 131, in such a manner that respective outer peripheral surfaces of the charge roller 132 and the photosensitive drum 131 are kept in contact with one another. On the basis of the position of the charge roller 132, the development device 134, the transfer roller 135, the cleaning device 136, the conductive brush 20 and the charge erasing lamp 137 are disposed in this order in a clockwise direction which is a rotational direction of the photosensitive drum 131 indicated by the arrow illustrated along the outer periphery of the photosensitive drum 131 in FIG. 1. The exposure device 133 is disposed at a position above the charge roller 132. The exposure device 133 includes a light source (not shown) disposed at a given position therein and adapted to emit a laser beam therefrom, and a mirror 133*a* for reflecting the laser beam from the light source to direct the reflected laser light to the outer peripheral surface of the photosensitive drum 131 through a gap between the charge roller 132 and the development device 134.

The photosensitive drum 131 is designed to allow an electrostatic latent image to be formed on the outer peripheral surface thereof in response to irradiation with the laser beam emitted from the light source of the exposure device 133 through the mirror 133*a*, and then allow a toner image to be formed correspondingly to the electrostatic latent image. For this purpose, a photosensitive layer 131*a* (see FIG. 2) is formed as the outermost layer of the photosensitive drum 131 to allow the outer peripheral surface of the photosensitive drum 131 to be adaptable for forming the electrostatic latent and toner images. The photosensitive drum 131 is supported by a drum shaft 131*b* inserted therein along an axis thereof, in such a manner as to be rotated about and together with the drum shaft 131*b*.

The charger roller 132 is operable to form a uniform electric charge layer on the outer peripheral surface of the photosensitive drum 131 which is being rotated about the drum axis in the clockwise direction. More specifically, the charger roller 132 is operable to uniformly charge the outer peripheral surface of the photosensitive drum 131 while being rotationally driven by the photosensitive drum 131 through the outer peripheral surface thereof in contact with the outer peripheral surface of the photosensitive drum 131.

The exposure device 133 is operable to irradiate the outer peripheral surface of the photosensitive drum 131 in a rotating state, with a laser light having intensity varied based on image data transmitted from an external device, such as a computer. Through this operation, electric charges on a portion of the outer peripheral surface of the photosensitive drum 131 scanningly irradiated with the laser light are erased to form an electrostatic latent image on the outer peripheral surface of the photosensitive drum 131.

The development device 134 is operable to supply toner particles onto the outer peripheral surface of the photosensitive drum 131 so as to attach toner particles onto a portion of the outer peripheral surface formed as the electrostatic latent image. Through this operation, a toner image is formed on the outer peripheral surface of the photosensitive drum 131.

The transfer roller 135 is operable to transfer the positively-charged toner image formed on the outer peripheral surface of the photosensitive drum 131, to the sheet P fed to a position immediately below the photosensitive drum 131. In order to achieve this operation, the transfer roller 135 is designed to impart to the sheet P negative electric charges which are opposite in polarity to the charges of the toner image. Thus, the sheet P reaching the position immediately below the photosensitive drum 131 is pressed and nipped between the transfer roller 135 and the photosensitive drum 131, and the positively-charged toner image on the outer peripheral surface of the photosensitive drum 131 is taken away therefrom toward a surface of the negatively-charged sheet P. In this manner, the sheet P is subjected to the transfer process.

The cleaning device 136 is operable to remove toner particles remaining on the outer peripheral surface of the photosensitive drum 131 after completion of the transfer process, so as to clean the outer peripheral surface of the photosensitive drum 131. The outer peripheral surface of the photosensitive drum 131 cleaned by the cleaning device 136 will be rotated toward the initial position or the charge roller 132 through the charge erasing lamp 137 to perform the next image forming job.

The conductive brush 20 is operable, before a voltage is re-applied by the charge roller 132 to initiate the next image forming job, to apply a voltage having the same polarity and value as those of the voltage in the charge roller 132, to the outer peripheral surface of the photosensitive drum 131 after being subjected to a cleaning process based on the cleaning device 136, while being reciprocated along an axial direction of the conductive brush 20. The conductive brush 20 is also operable to allow an extraneous substance (e.g. additive particles mixed with toner particles, such as submicron-order magnetic fine particles) which has slipped through a clearance between a blade (not shown) of the cleaning device 136 and the outer peripheral surface of the photosensitive drum 131, to be uniformly spread over approximately the entire outer peripheral surface of the photosensitive drum 131. The details of the conductive brush 20 will be more specifically described later.

The charge erasing lamp 137 is operable to emit light onto the outer peripheral surface of the photosensitive drum 131 after being applied with the voltage from the conductive brush 20, so as to erase charges formed on the outer peripheral surface of the photosensitive drum 131. The charge erasing lamp 137 can erase any charged area in the photosensitive drum 131 so as to allow the outer peripheral surface of the photosensitive drum 131 to be uniformly charged by the charge roller 132.

The fixing section 14 serves as a means to heat the toner image on the sheet P after being subjected to the transfer process based on the transfer section 13, so as to subject the sheet P to the fixing process. The fixing section 14 is provided with a heating roller 141 for imparting heat to the sheet P, and a pressing roller 142 disposed below and in opposed relation to the heating roller 141 in such a manner that an outer peripheral surface thereof comes into contact with the heating roller 141. The sheet P after completion of the transfer process is fed into a nip zone N defined between the heating roller 141 and the pressing roller 142. The heating roller 141 is operable to heat the sheet P passing through the nip zone N so as to subject the sheet P to the fixing process. The sheet P after being subjected to the fixing process will be ejected to the sheet receiving section 15 through a sheet ejection passage 143.

The sheet receiving section 15 is formed by concaving the top portion of the apparatus body 11 to define a concaved depression with a bottom serving as a catch tray 151 for receiving the ejected sheet P.

Figure 2:
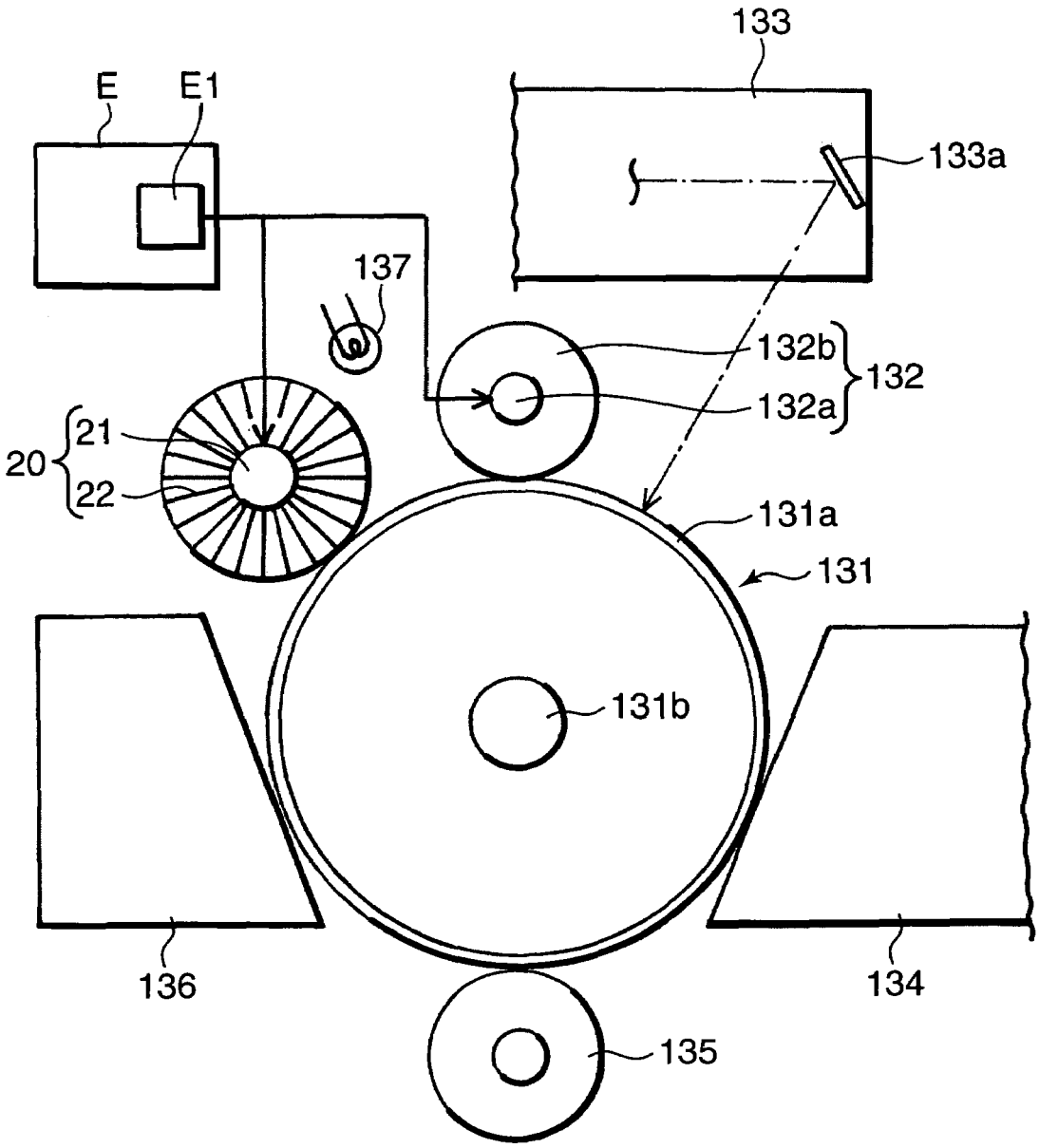
FIG. 2 is an explanatory enlarged view showing a photosensitive drum and components associated therewith in FIG. 1.

FIG. 2 is an explanatory enlarged view showing the photosensitive drum 131 and the components associated therewith. As shown in FIG. 2, the charge roller 132 is disposed such that the outer peripheral surface thereof is kept in contact with the outer peripheral surface (or the photosensitive layer 131*a*) of the photosensitive drum 131, and designed to apply a voltage from a DC power supply device E to the photosensitive layer 131*a*. The charge roller 132 comprises a charge-roller shaft 132*a* made of metal, and a charge-roller body

132*b* made of a dielectric material such as elastomer and fitted integrally and concentrically onto the charge-roller shaft 132*a*. A voltage from the DC power supply device E is applied to the metal charge-roller shaft 132*a*. Based on this voltage applied to the metal charge-roller shaft 132*a*, the surface of the photosensitive drum 131 is electrostatically charged through the charge-roller body 132*b* made of a dielectric material.

The DC power supply device E includes a constant current control circuit E1. A DC current to be supplied to the charge roller 132 is adjusted at a predetermined constant value (reference current value i) through the constant current control circuit E1. Thus, if a resistance value Ra of the charge-roller body 132*b* is varied, a voltage value V ($V=i\times R$) of the outer peripheral surface of the charge-roller body 132*b* will be changed in proportion to the variation of the resistance value Ra.

If the resistance value Ra of the charge-roller body 132*b* is increased due to an extraneous substance attached on the outer peripheral surface of the charge-roller body 132*b*, the photosensitive layer 131*a* cannot be adequately charged at a desired level without some measures. As measures against this problem, the above constant current control is employed to allow the voltage value V is changed in proportion to the resistance value Ra.

Preferably, a charge roller having a resistance value within a range of 5 to 10 in logarithmic form (log Ra) is employed as the charge-roller body 132*b* in this embodiment.

The conductive brush 20 has a cylindrical shape, and comprises a brush shaft 21 made of metal and formed to have a length slightly greater than that of the photosensitive drum 131, and a plurality of brush bristles 22 which are fixed to an outer peripheral surface of the brush shaft 21 to extend outward from the outer peripheral surface of the brush shaft 21 in a radial pattern concentric to the brush shaft 21, and densely distributed over the outer peripheral surface of the brush shaft 21. The conductive brush 20 is disposed to allow free ends of the brush bristles 22 to come into contact with the photosensitive drum 131*a* of the photosensitive drum 131. Each of the brush bristles 22 is made of a given synthetic resin dispersedly containing metal fibers or electrically conductive fine particles, such as carbon black particles, to have electrical conductivity.

A voltage is applied from the DC power supply device E to the conductive brush 20. The conductive brush 20 serves as means to subject the outer peripheral surface of the photosensitive drum 131 to a preliminary charge process, before the outer peripheral surface of the photosensitive drum 131 is subjected to the primary charge process based on the charge roller 132 as a part of preparation for a next transfer process. Through this preliminary charge process, electric charges of a given polarity are provided on the outer peripheral surface of the photosensitive drum 131 to counteract an opposite-polarity transfer memory on the outer peripheral surface of the photosensitive drum 131 due to charges moved from the transfer roller 135.

After the above counteraction, the electric charges on the outer peripheral surface of the photosensitive drum 131 are erased by irradiation with light from the charge erasing lamp 137. This makes it possible to eliminate adverse influences of the transfer memory due to charges moved from the transfer roller 135 to the outer peripheral surface of the photosensitive drum 131 so as to adequately perform the primary charge process for the photosensitive layer 131*a*.

In this embodiment, a voltage generated by the DC power supply device E is applied to the brush shaft 21 after being subjected to the constant current control through the constant current control circuit E1, as with the charge roller 132. The reason is the same as that in the charge roller 132. Further, in this embodiment, the conductive brush 20 has a resistance value set in the same range as that in the charge-roller body 132*b* (i.e. a value within a range of 5 to 10 in logarithmic form, log Rb).

The brush bristles 22 are used for subjecting the photosensitive layer 131*a* to the preliminary charge process. Even after the cleaning process based on the cleaning device 136, a toner additive (silica, titanium, etc.) with a submicron-order particle size is likely to be left on the outer peripheral surface of the photosensitive drum 131. The brush bristles 22 also serve as means to spread out such an extraneous substance in a sweeping manner.

In this embodiment, the conductive brush 20 is rotated (or rotationally moved) about an axis of the conductive brush 20, and simultaneously reciprocated along the outer peripheral surface of the photosensitive drum 131 and in a direction orthogonal to the movement direction of the outer peripheral surface of the photosensitive drum 131. The conductive brush 20 is reciprocated by the following reason. An extraneous substance, such as the aforementioned additive particles, which has slipped through a clearance between the blade (not shown) of the cleaning device 136 and the outer peripheral surface of the photosensitive drum 131 and has not been brushed away by the conductive brush 20 is likely to be attached onto a portion of the outer peripheral surface of the charge-roller body 132*b* when it reaches the portion of the outer peripheral surface according to the rotation of the photosensitive drum 131. If the extraneous substance is attached onto the portion of the outer peripheral surface of the charge-roller body 132*b*, the resistance value of the charge-roller body 132*b* becomes uneven. This makes it difficult to uniformly charge the outer peripheral surface of the photosensitive drum 131, or causes a problem about the so-called "charge nonuniformity".

As mentioned above, through various experimental tests, the inventor found that, even if an extraneous substance is attached onto an outer peripheral surface of the charge-roller body 132*b*, as long as the extraneous substance is uniformly attached thereonto, no charge nonuniformity occurs in the outer peripheral surface of the photosensitive drum 131.

Thus, in this embodiment, instead of removing contaminations on the outer peripheral surface of the charge-roller body 132*b* by use of a brush roller exclusive to a charge roller 132 as in the conventional technique, the conductive brush 20 is reciprocated along the axial direction thereof in advance of the primary charge process to spread an extraneous substance remaining on the outer peripheral surface of the photosensitive drum 131, over the entire outer peripheral surface, so as to provide a uniform distribution of the attached extraneous substance. In this way, the contaminant uniformly distributed over the entire outer peripheral surface of the photosensitive drum 131 is attached onto the outer peripheral surface of the charge-roller body 132*b* in a uniform distribution, so that the charge-roller body 132*b* can impart electric charges to the outer peripheral surface of the photosensitive drum 131 without charge nonuniformity.

By comparison, in cases where a plural number of the sheets P are sequentially subjected to the transfer process based on the same image information by the conventional techniques, the following phenomenon is observed. Additive particles (extraneous substance) which have slipped through the blade of the cleaning device 136 are concentrated in the same position of the outer peripheral surface of the charge-roller body 132*b*. Thus, the outer peripheral surface of the charge-roller body 132*b* is unevenly contaminated by the extraneous substance, and the outer peripheral surface of the photosensitive drum 131 will be nonuniformly charged due to imbalance between respective resistance values in the contaminated portion and remaining non-contaminated portion. As the result, defective images will be formed.

Figure 3:
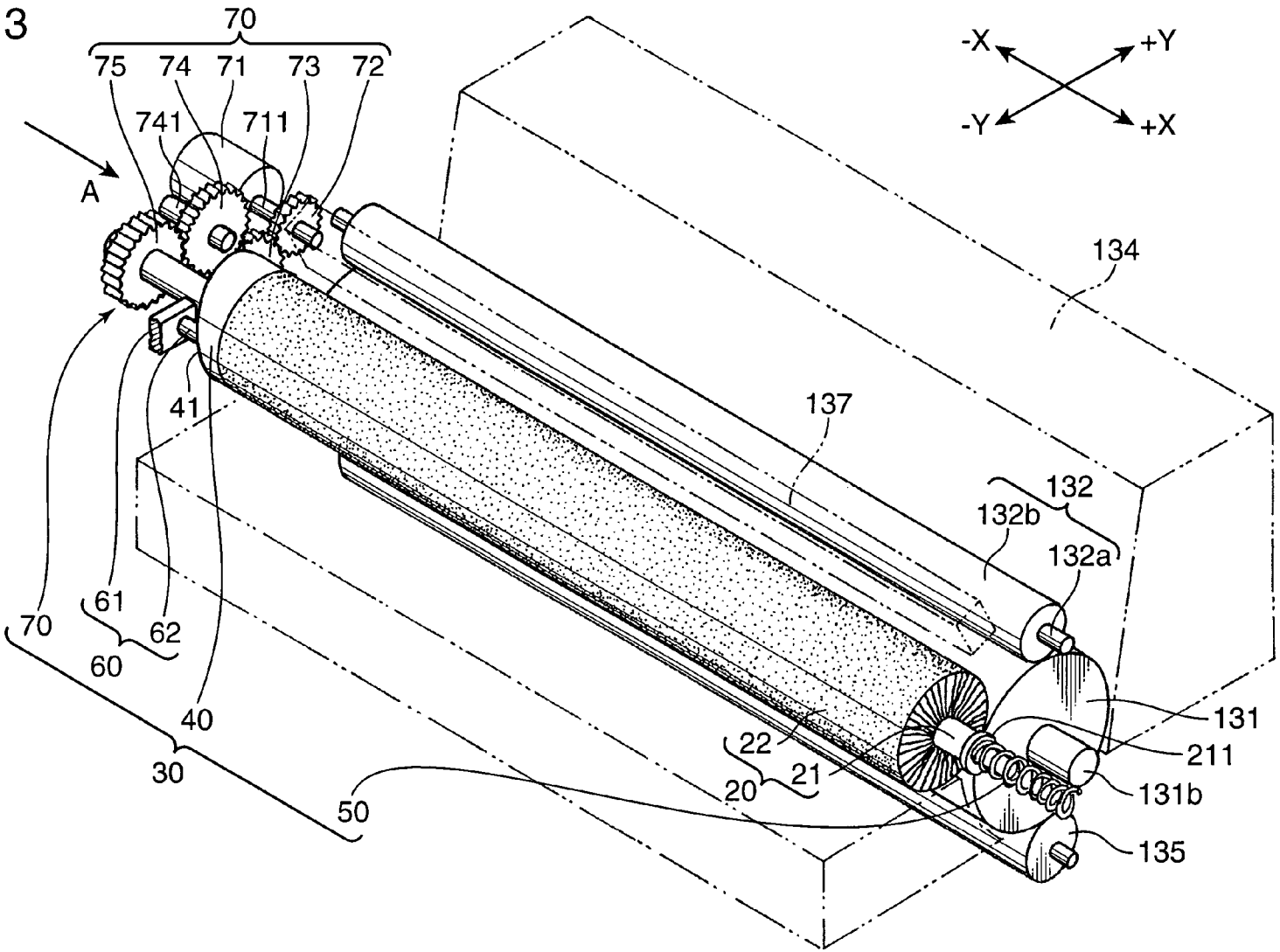
FIG. 3 an explanatory perspective view showing an electrically conductive brush in FIG. 1 and a reciprocating mechanism.
Figure 4:
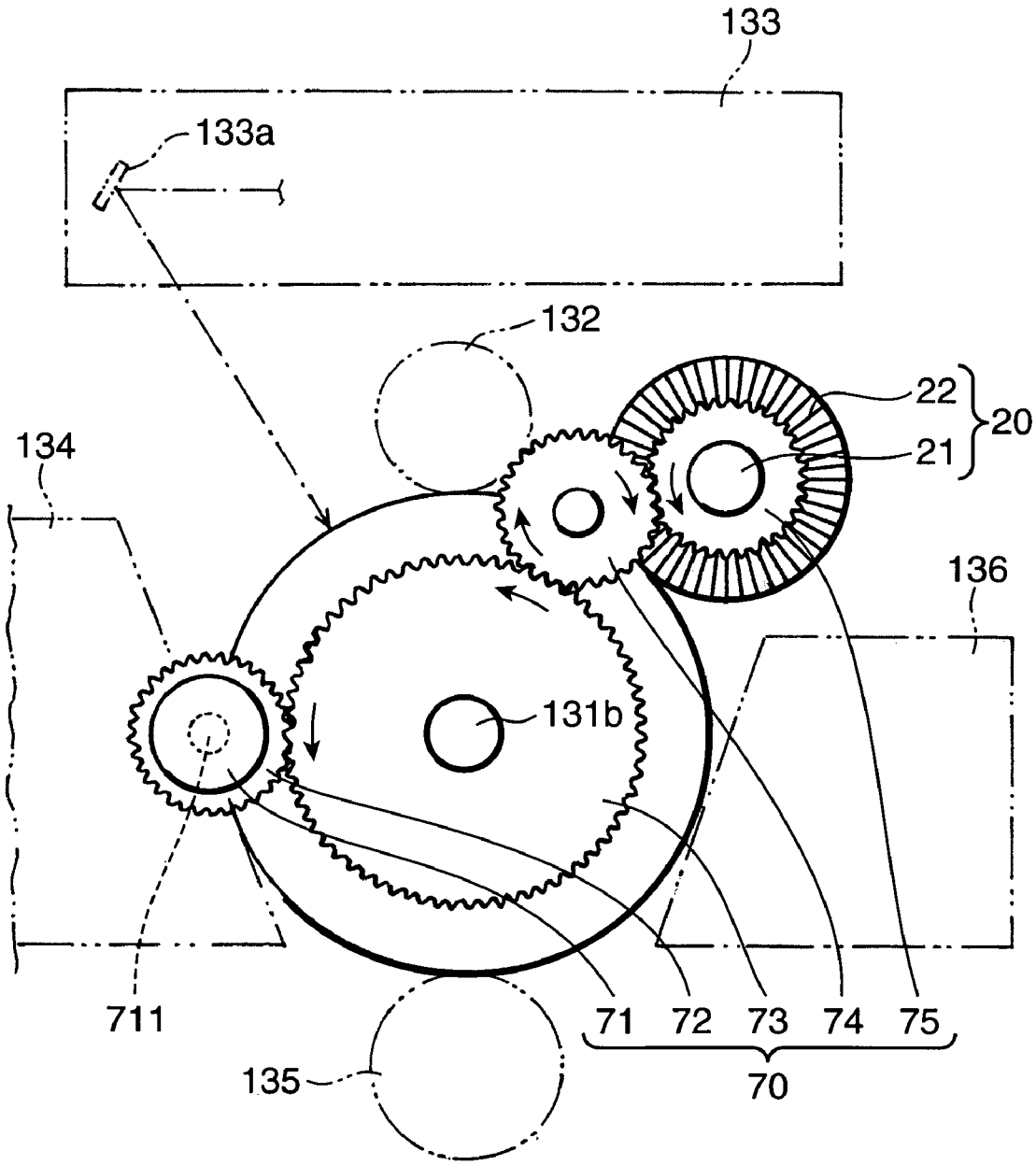
FIG. 4 is an explanatory diagram showing the reciprocating mechanism, viewed in a direction indicated by the arrow A in FIG. 3.

With reference to FIGS. 3 and 4, a reciprocating mechanism 30 for reciprocating the conductive brush 20 in a horizontal direction will be described below. FIG. 3 an explanatory perspective view showing the conductive brush 20 and the reciprocating mechanism 30. FIG. 4 is an explanatory diagram showing the reciprocating mechanism 30, viewed in a direction indicated by the arrow A in FIG. 3. In FIGS. 3 and 4, an X-X direction and a Y-Y direction will be referred to respectively as "lateral direction" and "longitudinal direction". Further, in more specific descriptions, −X direction, +X direction, −Y direction and +Y direction will be referred to as "leftward (or left)", "rightward (or right)", "frontward (or front)" and "rearward (or rear)".

As shown in these figures, the reciprocating mechanism 30 comprises a cam disk 40, a coil spring (bias member) 50, a contact member 60 and a driving-force transmitting mechanism 70. The cam disk 40 is concentrically connected to one (left end in FIG. 3) of opposite ends of the brush shaft 21 in an integral manner. The cam disk 40 has an outward side surface formed as an inclined surface 41 inclining relative to the axial direction of the brush shaft 21. The coil spring 50 is associated with the other end (right end in FIG. 3) of the brush shaft 21 to bias the brush shaft 21 toward the cam disk 40. The contact member 60 is disposed in contact with the inclined surface 41 of the cam disk 40 while being restricted from moving in the axial direction of the brush shaft 21. The driving-force transmitting mechanism 70 is designed to rotationally drive the conductive brush 20 about an axis of the conductive brush 20.

The inclined surface 41 of the cam disk 40 is formed by cutting a columnar-shaped member obliquely relative to an axial direction thereof.

The coil spring 50 is fitted on one end of the brush shaft 21 protruding rightward from the brush bristles 22, and the brush shaft 21 has a flange 211 for stopping a left end of the coil spring 50 in a compressed manner. The coil spring 50 has a right end stopped by a frame (not shown) disposed within the apparatus body (see FIG. 1) of the printer 10. Thus, the conductive brush 20 is biased leftward by a biasing force of the coil spring 50, and received by the contact member 60 through the cam disk 40, so as to restrict a leftward movement of the conductive brush 20.

The contact member 60 comprises a base 61 fixed to a given frame of the apparatus body 11 at a position located slightly leftward relatively to the cam disk 40, and a contact segment 62 protruding from the base 61 toward the inclined surface 41 of the cam disk 40. The contact segment 62 has a distal end formed in a semispherical shape (see FIG. 5) for facilitating a smooth sliding between the distal end of the contact segment 62 and the inclined surface 41 of the cam disk 40.

As shown in FIGS. 3 and 4, the driving-force transmitting mechanism 70 comprises a drive motor 71 mounted to a given frame in such a manner that a drive shaft 711 of the drive motor 71 extends laterally (a direction orthogonal to the drawing sheet of FIG. 4) at a position located on a rearward side of the photosensitive drum 131, a drive gear 72 fitted on the drive shaft 711 of the drive motor 71 concentrically and rotatably in an integral manner, a drum gear 73 fitted on the drum shaft 131*b* concentrically and rotatably in an integral manner and engaged with the drive gear 72, an idle gear 74 supported by an idle shaft 741 concentrically and rotatably about the idle shaft 741, and a brush gear 75 fitted on the brush shaft 21 concentrically and integrally rotatably.

In this embodiment, a gear ratio between the drum gear 73 and the brush gear 75 is set to allow the conductive brush 20 to have a circumferential speed greater than that of the photosensitive drum 131. Thus, the conductive brush 20 is rotated about the axis of the conductive brush 20 in the same direction at a circumferential speed greater than that of the photosensitive drum 131.

In the driving-force transmitting mechanism 70 having the above structure, upon activation of the drive motor 71, a driving force of the drive motor 71 is transmitted to the drum gear 73 through the drive gear 72 to rotate the photosensitive drum 131 about the drum shaft 131*b*. This rotational driving force is transmitted to the conductive brush 20 through the drum gear 73, the idle gear 74 and the brush gear 75 to rotate the conductive brush 20 about the axis of the conductive brush 20 at a circumferential speed greater than that of the photosensitive drum 131. Thus, based on this rotational movement of the conductive brush 20, the outer peripheral surface of the photosensitive drum 131 is sweepingly cleaned by the brush bristles 22.

Figure 5A:
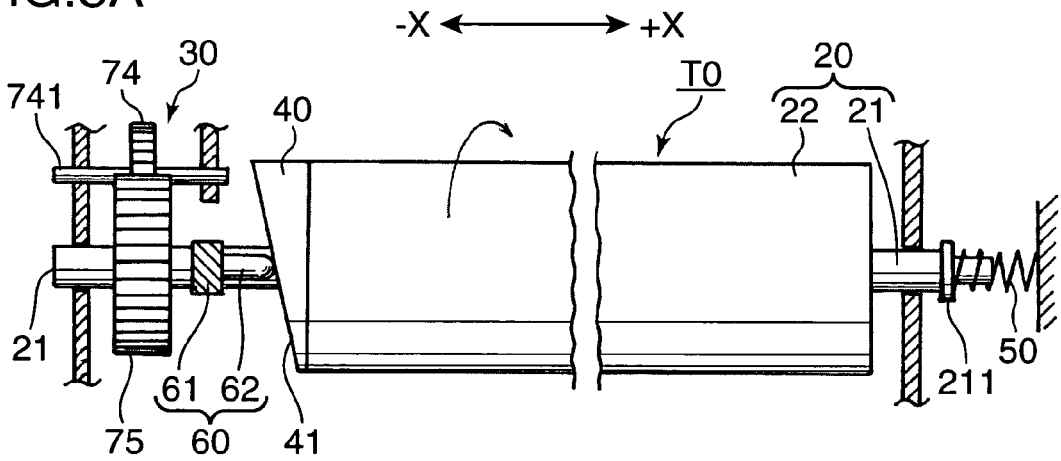
Figure 5B:
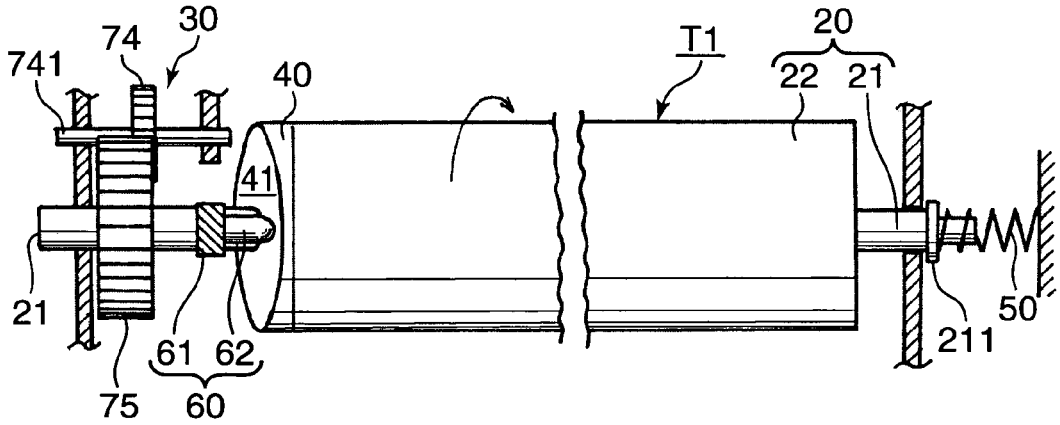
Figure 5C:
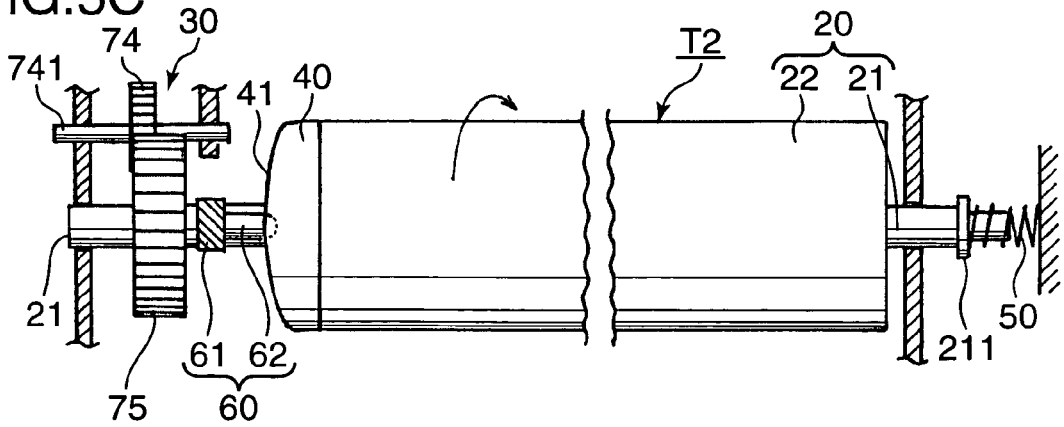

FIGS. 5A to 5C are explanatory diagrams of an operation of the reciprocating mechanism. FIG. 5A shows the reciprocating mechanism in a state when the conductive brush 20 is located at an intermediate position T0, and FIG. 5B shows the reciprocating mechanism in a state when the conductive brush 20 is located at a leftward position T1. FIG. 5C shows the reciprocating mechanism in a state when the conductive brush 20 is located at a rightward position T2. The definitions of X directions in FIGS. 5A to 5C are the same as those in FIG. 3 [i.e. X: lateral direction (−X: leftward (or left), +X: rightward (or right))].

In the state illustrated in FIG. 5A, the distal end of the contact segment 62 is in contact with a minor axis in the 1st and 4th quadrants of the inclined surface having an oval shape [a portion of the minor axis on a frontward side (the obverse side of the drawing sheet of FIG. 5A) of the inclined surface 41 having a negative inclination when viewed from the front side of FIG. 5A], and the conductive brush 20 is pressed against the contact segment 62 by the biasing force of the coil spring 50. In this state, the conductive brush 20 is located at the intermediate position T0 where it is opposed to the photosensitive drum 131.

When the conductive brush 20 is rotated from the intermediate position T0 at 90 degrees in a clockwise direction (when viewed from the right side) about the axis of the conductive brush 20, the conductive brush 20 is pressed by the coil spring 50, and the distal end of the contact segment 62 is in contact with a major axis in the 3rd and 4th quadrants of the inclined surface 41. Thus, as shown in FIG. 5B, the conductive brush 20 is moved to the leftward position T1.

Then, when the conductive brush 20 is further rotated from the leftward position T1 in the clockwise direction, the inclined surface 41 of the cam disk 40 is gradually pressed rightward by and relative to the distal end of the contact segment 62 against the biasing force of the coil spring 50. Subsequently, when the conductive brush 20 is rotated from the position illustrated in FIG. 5B at 180 degrees in the clockwise direction, the distal end of the contact segment 62 comes into contact with the major axis in the 1st and 2nd quadrants of the inclined surface 41, as shown in FIG. 5C. That is, the conductive brush 20 is located at the rightward position T2.

In this way, when the conductive brush 20 is continuously rotated about the axis of the conductive brush 20 by the driving force of the drive motor 71 (see FIG. 3), the conductive brush 20 will be reciprocated between the leftward position T1 illustrated in FIG. 5B the rightward position T2 illustrated in FIG. 5C.

As described above in detail, the printer 10 according to the above embodiment of the present invention comprises: the photosensitive drum 131 adapted to be rotated about the drum shaft 131*b*; the charge roller 132 adapted to subject the outer peripheral surface of the photosensitive drum 131 to the charge process while being in contact with the outer peripheral surface of the photosensitive drum 131; and the charge erasing lamp 137 disposed on an upstream side of the photosensitive drum 131 relative to the charge roller 132 and adapted to erase the charged area in the photosensitive drum 131. The printer 10 further includes the conductive brush 20 disposed on an upstream side of the photosensitive drum 131 relative to the charge erasing lamp 137 and adapted to apply to the outer peripheral surface of the photosensitive drum 131 a voltage of the same polarity as that of a voltage to be applied from the charge roller 132 to the outer peripheral surface, while being in contact with the outer peripheral surface; and the reciprocating mechanism 30 for reciprocating the conductive brush 20 in the directions parallel to the outer peripheral surface of the photosensitive drum 131 and orthogonal to the movement direction of the outer peripheral surface.

In the above printer 10, the outer peripheral surface of the photosensitive drum 131 being rotated about the drum shaft 131*b* is applied with a voltage from the charge roller 132 in contact therewith, so that the outer peripheral surface of the photosensitive drum 131 is subjected to the charge process in sequence. Then, an electrostatic latent image is formed on the outer peripheral surface of the photosensitive drum 131. Further, toner particles are supplied to the electrostatic latent image to form a toner image, and this toner image is transferred to the sheet P.

After the transfer process, the outer peripheral surface of the photosensitive drum 131 is subjected to the cleaning process based on the cleaning device 136. Then, the cleaned outer peripheral surface of the photosensitive drum 131 is applied with the voltage of the same polarity as that of the voltage in the charge roller 132, from the conductive brush 20 which is being reciprocated in two directions which are orthogonal to the movement direction of the outer peripheral surface of the photosensitive drum 131, and parallel to the outer peripheral surface of the photosensitive drum 131, by the reciprocating mechanism 30. In this way, before a voltage is applied by the charge roller 132, the cleaned surface of the photosensitive drum 131 is subjected to the preliminary charge process. Thus, even if a transfer memory of opposite-polarity charges is formed and left on the cleaned outer peripheral surface of the photosensitive drum 131, it can be counteracted. Subsequently, the outer peripheral surface of the photosensitive drum 131 is subject to the charge erasing process based on the charge erasing lamp 137, and then uniformly re-charged by the charge roller 132 to perform the next image forming job.

As above, the conductive brush 20 is reciprocated along the outer peripheral surface of the photosensitive drum 131 and in the direction orthogonal to the movement direction of the surface of the photosensitive drum 131, by the reciprocating mechanism 30. Thus, even if the outer peripheral surface of the photosensitive drum 131 has an extraneous substance attached thereon, the extraneous substance is uniformly spread over the outer peripheral surface of the photosensitive drum 131 by the reciprocating movements of the conductive brush 20. That is, even if the uniformly-spread extraneous substance on the outer peripheral surface of the photosensitive drum 131 reaching an outer peripheral surface of the charge roller 132 is attached onto the outer peripheral surface of the charge roller 132, the attached extraneous substance will be uniformly distributed over the outer peripheral surface of the charge roller 132. Therefore, the outer peripheral surface of the photosensitive drum 131 subjected to the charge process through contact with the charge roller 132 can be uniformly charged. This makes it possible to effectively prevent the occurrence of charge nonuniformity in the outer peripheral surface of the photosensitive drum 131 so as to reliably avoid image nonuniformity due to the charge nonuniformity.

In the above embodiment, the photosensitive drum 131 adapted to be rotate about the drum shaft 131*b* concentrically fixed thereto is employed as a photosensitive member. Thus, the photosensitive drum 131 can be rotated about the drum shaft 131*b* to move the surface of photosensitive drum 131 so as to provide a structurally simplified photosensitive member.

In the above embodiment, the conductive brush 20 having plurality of brush bristles 22 concentrically fixed to and densely distributed over the brush shaft 21 is employed as a preliminary voltage-applying member. Thus, an extraneous substance attached on the outer peripheral surface of the photosensitive drum 131 is sweepingly cleaned by the brush bristles 22 of the conductive brush 20 rotated about the axis of the conductive brush 20, while being applied with the voltage through the brush bristles 22. Further, the remaining extraneous substance which has not being sweepingly cleaned can be spread over the outer peripheral surface of the photosensitive drum 131 approximately uniformly by a thrusting movement of the conductive brush 20.

The reciprocating mechanism 30 includes the cam disk 40 concentrically connected to one of opposite ends of the brush shaft 21 in an integral manner. The cam disk 40 has an outward side surface formed as an inclined surface 41 inclining relative to the axial direction of the brush shaft 21. The reciprocating mechanism 30 further includes the coil spring 50 associated with the other end of the brush shaft 21 to bias the brush shaft 21 toward the cam disk 40, and the contact segment 62 disposed in contact with the inclined surface 41 of the cam disk 40 while being restricted from moving in the axial direction of the brush shaft 21.

According to the reciprocating mechanism 30, the conductive brush 20 is pressingly clamped between the contact segment 62 in contact with the inclined surface 41 of the cam disk 40 concentrically fixed to one end of the brush shaft 21 in an integral manner and the coil spring 50 associated with the other end of the brush shaft 21. Thus, when the conductive brush 20 is rotated about the axis of the conductive brush 20, the cam disk 40 concentric to and integral with the conductive brush 20 is rotated about the axis of the conductive brush 20 together with the conductive brush 20, and a contact position of the contact segment 62 relative to the inclined surface 41 of the cam disk 40 is changed. This allows the conductive brush 20 to be reciprocated along the axial direction while being biased by the coil spring 50.

As above, the reciprocating mechanism 30 for reciprocating the conductive brush 20 can be achieved using the cam disk 40, the coil spring 50 and the contact segment 62. Thus, as compared, for example, with a mechanism designed to reciprocate an electrically conductive member based on reciprocating movements of a piston in a cylinder device, the reciprocating mechanism 30 can have a simplified structure with a reduced number of components.

In the above embodiment, the printer 10 includes the DC current power supply device E for applying a voltage to the charge roller 132. Further, the constant current control circuit E1 is interposed between the DC current power supply device E and the charge roller 132 to controllably maintain a current to be supplied to the charge roller 132, at a constant value. Thus, even if a resistance value of the charge roller 132 is varied due to an extraneous substance attached on the charge roller 132, the current to be supplied to the charge roller 132 can be maintained at a predetermined value by the function of the constant current control circuit E1. Thus, the voltage to be applied to the charge roller 132 is changed in proportion to the resistance value of the charge roller 132. This makes to possible to reliably prevent variation in charged state of the outer peripheral surface of the photosensitive drum 131 due to variation in the resistance value of the charge roller 132 caused by attachment of an extraneous substance, so as to reliably obtain a stable charged state.

In addition, the reciprocating movement of the conductive blush 20 allows an extraneous substance attached on the outer peripheral surface of the photosensitive drum 131 to be spread over the outer peripheral surface of the photosensitive drum 131. That is, even if this extraneous substance is attached onto the outer peripheral surface of the charge roller 132, it will be attached in a uniform distribution, and the charge roller 132 can form a uniform charge layer on the outer peripheral surface of the photosensitive drum 131 subjected to the charge process. Thus, the risk of charge nonuniformity in the outer peripheral surface of the photosensitive drum 131 can be eliminated without the need for employing a complicated technique of applying to the charge roller 132 the so-called superimposed voltage formed by superimposing an AC voltage on a DC voltage, or the need for providing a cleaner for cleaning the outer peripheral surface of the photosensitive drum 131. This contributes to reduction in energy cost and component cost.

In order to verify the effects of the present invention, a verification test on the effects was conducted using an actual printer 10. A photosensitive drum 131 used in the printer 10 had a photosensitive layer 131*a* to be positively charged, as the uppermost layer (this layer was made of organic photosensitive material, in this example).

A charge-roller body 132*b* of a charge roller 132 used in the printer 10 had a resistance value Ra of 6.0 in logarithmic form (log Ra). A DC voltage to be applied to the charge-roller body 132*b* was set at 1200 V.

A conductive brush 20 used in the printer 10 had a resistance value Ra of 8.0 in logarithmic form (log Rb). A stroke of reciprocating movements of the conductive brush 20 was set at 2.0 mm. A DC voltage to be applied to the conductive brush 20 was set at a value identical to that for the charge roller 132.

100,000 sheets P were continuously subjected to printing using the above printer 10, and the resulting printed sheets were visually checked one-by-one. As the result of the test, no image nonuniformity was visually observed in the printed sheets.

Further, it was checked whether or not a transfer memory formed on an outer peripheral surface of the photosensitive drum 131 due to a contact of the outer peripheral surface of the photosensitive drum 131 with a transfer roller 135 through the sheet P is erased before the charge roller 132. As the result, it was verified that such a transfer memory was erased.

As a comparative example, except that the conductive brush 20 was not reciprocated, 100,000 sheets P were subjected to printing under the same conditions as those in the above example. In visual check of the resulting printed sheets, it was proven that nonuniformity in printed image occurred after completion of printing for about 2,000 sheets. Further, it was observed that image nonuniformity became prominent in the 100,000 printed sheets P.

Based on the above test result obtained using an actual apparatus, it could be verified that the technique of reciprocating the conductive brush 20 according to the present invention has excellent effects of being able to reliably prevent the occurrence of image nonuniformity, and reliably erase a transfer memory formed on the outer peripheral surface of the photosensitive drum 131.

The present invention is not limited to the above embodiment. For example, the above embodiment may be modified as follows.

(1) While the above embodiment has been described based on the printer 10 as one example of an image forming apparatus, the image forming apparatus as the subject of the present invention is limited to a printer 10, but may be a copying machine or a facsimile machine.

(2) In the above embodiment, the photosensitive drum 131 is used as a photosensitive member. Instead of a photosensitive drum 131, a photosensitive belt wound around between a pair of rollers in a tensioned manner may be used.

(3) The image forming apparatus according to the above embodiment is designed to maintain a current to be supplied to the charge roller 132, at a constant value based on the constant current control so as to apply a voltage to the charge roller 132 in proportion to a resistance value of the charge roller 132. Instead of this technique, the image forming apparatus may be designed to automatically increase a voltage value in response to an elapse of a given time pre-set considering a general pattern of contamination.

(4) While the image forming apparatus according to the above embodiment uses the conductive brush 20 as a preliminary voltage-applying member, the preliminary voltage-applying member to be used in the present invention is not limited to a conductive brush 20, but may be a blade or sheet member having an electrical conductivity suitably adjusted to preliminarily apply a voltage.

Figure 6:
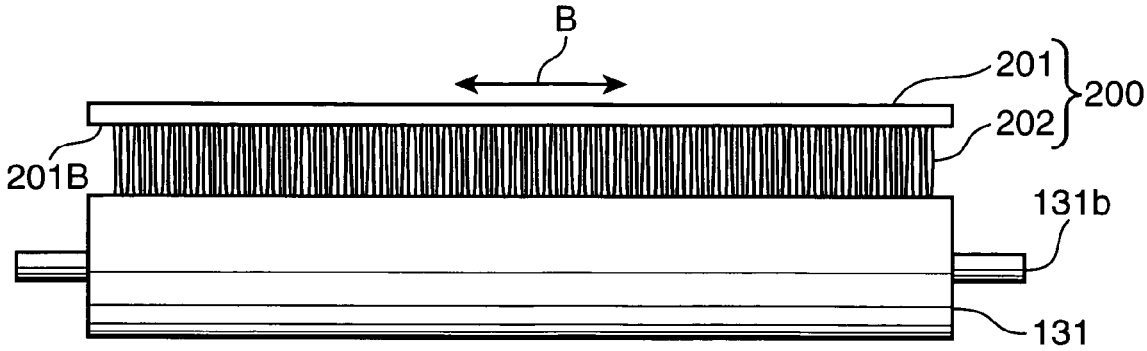
FIG. 6 is a side view showing one example of modification of the conductive brush.

(5) In the above embodiment, the conductive brush 20 is formed in a cylindrical shape and designed to be rotationally driven about the axis of the conductive brush 20 by the driving-force transmission mechanism 70. In place of this conductive brush 20, as shown in FIG. 6, a toothbrush-like conductive brush 200 may comprising a brush shaft 201 having one surface 201B extending in a longitudinal direction thereof, and a plurality of brush bristles 202 fixed to and extending outward from the surface 201B, and distributed to cover over approximately the entire area of the surface 201B. In this case, the brush shaft 201 is designed to be reciprocated in a width direction of a photosensitive drum 131 as indicated by the arrows B in FIG. 6. In a similar manner to the above embodiment, an outer peripheral surface of the photosensitive drum 131 is applied with a voltage through the brush bristles 202 of the conductive brush 200, and sliding rubbed with the brush bristles 202 which are reciprocated in the axial direction. Thus, an extraneous substance attached on the outer peripheral surface of the photosensitive drum 131 can be effectively spread or distributed over the outer peripheral surface of the photosensitive drum 131.

This application is based on patent application No. 2005-155423 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. An image forming apparatus comprising:

a photosensitive member adapted to be rotationally or circulatingly moved;

a charge roller adapted to subject a surface of said photosensitive member to a charge process while being in contact with the surface of said photosensitive member;

a charge erasing device disposed around said photosensitive member and on an upstream side relative to said charge roller in a direction of the rotational or circulating movement of said photosensitive member, and adapted to erase the charged area in said photosensitive member;

a cleaning device operable to come into contact with an outer peripheral surface of said photosensitive member to remove toner particles remaining on the outer surface of said photosensitive member after completion of a transfer process;

a preliminary voltage-applying member disposed around said photosensitive member and on an upstream side relative to said charge erasing device and on a downstream side relative to said cleaning device in the direction of the rotational or circulating movement of said photosensitive member, and adapted to apply to the surface of said photosensitive member a voltage of the same polarity as that of a voltage to be applied from said charge roller to said surface, while being in contact with said surface; and a reciprocating mechanism for reciprocating said preliminary voltage-applying member along the surface of said photosensitive member and in a direction orthogonal to the movement direction of said surface.

2. The image forming apparatus as defined in claim 1, wherein said photosensitive member is composed of a photosensitive drum adapted to be rotated about a given drum shaft concentrically fixed thereto.

3. The image forming apparatus as defined in claim 2, wherein said preliminary voltage-applying member is composed of an electrically conductive brush which includes a brush shaft, and a plurality of brush bristles fixed to and extending outward from said brush shaft, said conductive brush being disposed at a position allowing said brush bristles to come into sliding contact with a surface of said photosensitive drum.

4. The image forming apparatus as defined in claim 3, wherein said conductive brush has a cylindrical shape, wherein said brush bristles are densely distributed around said brush shaft, and said conductive brush is adapted to be rotationally driven about an axis of said conductive brush.

5. The image forming apparatus as defined in claim 3, wherein said brush shaft has one surface extending in a longitudinal direction thereof, and said brush bristles are distributed to cover over approximately the entire area of said one surface.

6. The image forming apparatus as defined in claim 3, wherein said conductive brush has a resistance value within a range of 5 to 10 in logarithmic form.

7. The image forming apparatus as defined in claim 3, wherein said reciprocating mechanism includes:

a cam disk concentrically connected to one of opposite ends of said brush shaft in an integral manner, said cam disk having an outward side surface formed as an inclined surface inclining relative to an axial direction of said brush shaft;

a bias member associated with the other end of said brush shaft to bias said brush shaft toward said cam disk; and a contact segment disposed in contact with the inclined surface of said cam disk while being restricted from moving in the axial direction of said brush shaft.

8. The image forming apparatus as defined in claim 1, wherein said charge roller has a resistance value within a range of 5 to 10 in logarithmic form.

9. The image forming apparatus as defined in claim 1, which further includes:

a power supply device for applying a voltage to said charge roller; and a constant current control circuit for controllably maintaining a current to be supplied to said charge roller, at a constant value.

* * * * *